United States Patent [19]

Coppin

[11] Patent Number: 4,728,284

[45] Date of Patent: Mar. 1, 1988

[54] ADJUSTABLE COMBUSTION RATE AIR/FUEL PROPORTIONED BURNER ASSEMBLY

[75] Inventor: William P. Coppin, Muncie, Ind.

[73] Assignee: Maxon Corporation, Muncie, Ind.

[21] Appl. No.: 14,239

[22] Filed: Feb. 12, 1987

[51] Int. Cl.[4] ..... F23M 9/00

[52] U.S. Cl. ..... 431/182; 431/188; 239/402.5; 239/406; 239/414

[58] Field of Search ..... 239/402.5, 406, 414; 431/12, 181, 182, 188, 354; 137/625.3, 625.41

[56] References Cited

U.S. PATENT DOCUMENTS

| | | | |
|---|---|---|---|
| 3,229,748 | 1/1966 | Spielman | 431/352 |
| 3,371,699 | 3/1968 | Riot | 431/354 |
| 4,203,717 | 5/1980 | Facco et al. | 239/406 |
| 4,516,606 | 5/1985 | Worley | 137/625.3 |
| 4,534,166 | 8/1985 | Kelm et al. | 239/402.5 |

*Primary Examiner*—James C. Yeung

*Assistant Examiner*—Noah Kamen

*Attorney, Agent, or Firm*—Robert M. Ward

[57] ABSTRACT

The improved adjustable combustion rate air/fuel proportioned burner of the present invention includes an air chamber housing with a plurality of air exit holes therein, a fuel gas tube disposed within the air chamber housing having a wall which is generally coextensive with the wall of the air chamber housing and having gaseous fuel openings therein, and a rotatable face plate covering a portion of such coextensive wall and having openings therein substantially corresponding in shape, size and location to the air exit openings and gaseous fuel openings in such coextensive wall. The improved adjustable combustion rate air/fuel proportioned burner of the present invention functions by means of rotation of the rotatable face plate to expose a selected and variable cross-sectional area of the air exit openings and gaseous fuel openings simultaneously to maintain a preselected ratio of air to fuel gas for the burning thereof.

27 Claims, 6 Drawing Figures

ADJUSTABLE COMBUSTION RATE AIR/FUEL PROPORTIONED BURNER ASSEMBLY

BACKGROUND OF THE INVENTION

The present invention is directed to fuel gas burners, and more particularly to an improved adjustable combustion rate air/fuel proportioned burner assembly having at least a 10:1 turn-down ratio, at essentially "on ratio" or stoichiometric burning.

In the prior art, it has been difficult to achieve near stoichiometric balance over various extended turn down ranges for fuel gas burners without the necessity for complicated and thereby relatively expensive parts. Also, apparatus of these types have been needlessly complicated, and thus have necessitated greater costs in production, with correspondingly greater difficulty of maintenance and increased expense associated therewith.

It has also been difficult to operate such prior art burners to achieve the desirable turn-down ratio, such as ranges of greater than at least approximately a 10:1, while maintaining essentially "on ratio", or stoichiometric balance.

Prior art burner apparatus have also had the further difficulty of the inability to provide the particular desirable flame shapes which have been preferred in certain industries including the baking and printing industries.

In view of these and other difficulties, deficiencies and defects of prior art burner apparatus, it is a material object of the improved adjustable combustion rate air/fuel proportioned burner of the present invention to alleviate such difficulties, deficiencies and defects of such prior art apparatus.

It is a further object of the improved adjustable combustion rate air/fuel proportioned burner of the present invention to provide such a burner assembly having at least a 10:1 turn-down ratio while permitting essentially stoichiometric combustion.

It is a further object of the improved adjustable combustion rate air/fuel proportioned burner of the present invention to provide such stoichiometric balance over various extended turn-down ranges without the necessity for complicated and relatively expensive parts.

It is a yet further object of the improved adjustable combustion rate air/fuel proportioned burner of the present invention to provide a burner eliminating needlessly complicated and accordingly more costly burner apparatus components, and correspondingly to lower production and maintenance costs.

The above and other objects of the improved burner assembly of the present invention will become more evident to those of skill in the art upon review of the following summary of the invention.

SUMMARY OF THE INVENTION

The improved adjustable combustion rate air/fuel proportioned burner of the present invention in general includes an air chamber housing with a plurality of air exit holes therein, a fuel gas tube disposed within the air chamber housing having a wall which is generally coextensive with the wall of the air chamber housing and having gaseous fuel openings therein, and a rotatable face plate covering a portion of such coextensive wall and having openings therein substantially corresponding in shape, size and location to the air exit openings and gaseous fuel openings in such coextensive wall.

These elements of the improved adjustable combustion rate air/fuel proportioned burner of the present invention function by means of controlled and selected rotation of the rotatable face plate to provide a selected turn-down or turn-up ratio by means of exposing simultaneously a selected and variable cross-sectional area of the air exit openings and gaseous fuel openings and to maintain a pre-selected ratio of air to fuel gas for the burning thereof.

The improved adjustable combustion rate air/fuel proportioned burner of the present invention and preferred embodiments thereof will be better understood with reference to the following brief description of the drawing, detailed description of preferred embodiments, appended claims and accompnying drawing.

BRIEF SUMMARY OF THE DRAWING

Various preferred and selected alternative embodiments of the improved adjustable combustion rate air/fuel proportioned burner of the present invention are set forth in the drawing, and in which.

DETAILED DESCRIPTION OF PREFERRED EMBODIMENTS

Figure 1:
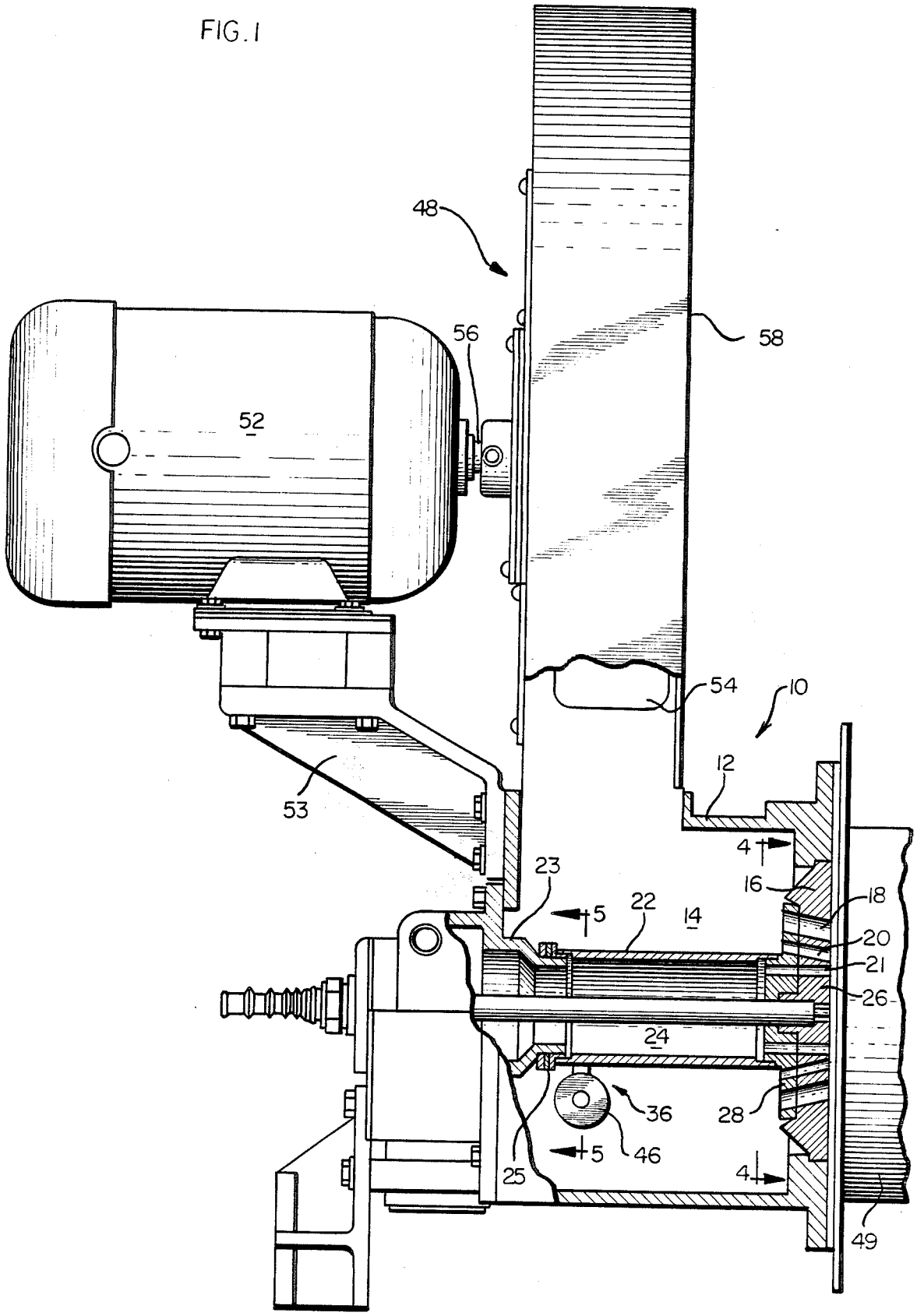
FIG. 1 is a partially cut-away and partially sectioned side view of the improved burner assembly of the present invention showing an air fan driven by a motor and which motor is supported upon a motor mount, with such air fan providing air under pressure to an air chamber, such air chamber containing therein a gaseous fuel tube, with the air chamber and gaseous fuel tube having a coextensive wall, the degree of opening of air and gas openings therein being controlled by the rotatable face plate attached to a manually operating cam assembly.

The improved adjustable combustion rate air/fuel proportioned burner of the present invention finds particular application in the baking and printing industry fields, and in the soft cookie industry in particular. Such improved burner apparatus finds such widespread application and usage based upon its turn-down range exceeding 10:1, while operating essentially stoichiometrically or "on ratio", and to do so by not exceeding 10% approximately of excess air.

The improved adjustable combustion rate air/fuel proportioned burner of the present invention includes an oxidizing gas housing defining an oxidizing gas chamber. Such chamber functions to contain an oxidizing gas, such as air, although mixtures of air and oxygen for oxygen enriched combustion may also be utilized. The oxidizing gas chamber has a stationarily disposed oxidizing gas wall with a plurality of oxidizing gas or air exit openings therein. A gaseous fuel tube defining a gaseous fuel chamber is disposed within the oxidizing gas chamber. The gaseous fuel chamber has a wall disposed at one end thereof which is generally coextensive with the oxidizing gas wall of the oxidizing gas chamber. A rotatable face plate is disposed for covering a portion of the wall of the oxidizing gas chamber and simultaneously the coextensive wall of the gaseous fuel chamber.

Such rotatable face plate likewise has openings therein substantially corresponding in shape, size and location to the oxidizing gas openings in the wall of the oxidizing gas chamber and the gaseous fuel openings in the wall of the gaseous fuel chamber. The improved burner apparatus of the present invention functions upon rotation of the rotatable face plate to selected respective cross-sectional areas of the oxidizing gas openings and the gaseous fuel openings which are simultaneously opened to the ambient atmosphere for flow of respectively oxidizing gas and gaseous fuel for combustion, and thereby to maintain the preselected ratio of oxidizing gas to the gaseous fuel upon combustion thereof.

In preferred embodiments of the improved burner apparatus of the present invention, the oxidizing gas openings in the oxidizing gas wall are disposed in at least one circular array on the oxidizing gas wall. Such oxidizing gas openings are preferably disposed in the oxidizing gas chamber wall to provide a plurality of converging oxidizing gas streams therefrom. Such oxidizing gas openings are also further disposed also to provide twisting to the plurality of such converging streams of oxidizing gas.

The oxidizing gas openings in the oxidizing gas wall are disposed in some preferred embodiments in a pair of concentrically disposed circular arrays.

The rotating face plate is attached to a gaseous fuel tube in some preferred embodiments and is rotatable by rotation of such fuel tube. In these and other preferred emobdiments, rotational means for driving the rotatable fuel tube in a rotational configuration, simultaneously to control the amount of gaseous fuel and oxidizing gas exiting from the face plate is likewise provided. In such preferred embodiments, the rotational means may preferably comprise a cam guide attached to the gaseous fuel tube, with a cam disposed substantially transversely to the longitudinal dimension of the gaseous fuel tube. Such cam in such preferred embodiments has a cam follower slot with the cam guide disposed therewithin. Such cam mechanism functions when the cam is turned and force is thereby directed against the cam guide, which in turn rotates the attached fuel tube, and thereby simultaneously controls the amount of oxidizing gas and gaseous fuel exiting from the face plate. In these and other preferred embodiments of the improved burner apparatus of the present invention the cam follower slot is preferably disposed obliquely across the exterior surface of the cam. In such embodiments, the cam is substantially cylindrical in shape. A manually graspable knob is further provided for turning the cam manually to control simultaneously the amount of gaseous fuel and oxidizing gas exiting from the face plate. In the above preferred embodiments, the cam follower slot may preferably be disposed preferably obliquely across the exterior surface of the cam at an angle of approximately 33° to the transverse of said cam.

In preferred embodiments of the improved burner apparatus of the present invention, a blower means is operably connected to the oxidizing gas chamber for supplying oxidizing gas to the oxidizing gas chamber.

The oxidizing gas openings within the rotatable face plate are preferably disposed at an angle of approximately 10° to the longitudinal axis of the rotatable gaseous fuel tube, thereby to provide a converging shape to the oxidizing gas expelled therethrough. The oxidizing gas openings of the oxidizing gas chamber are preferably also disposed at an angle of approximately 10° to the longitudinal axis of the rotatable gaseous fuel tube, thereby to provide a converging shape to the oxidizing gas expelled therethrough.

Such oxidizing gas openings in the rotatable face plate and the oxidizing gas openings in the oxidizing gas chamber are correspondingly converging in disposition with respect to the longitudinal axis of the rotatable gaseous fuel tube to provide a plurality of converging flames exiting therefrom. Such oxidizing gas openings in the rotatable face plate are further disposed at a twisting angle to the longitudinal dimension of the rotatable fuel tube. Such structure functions to twist the flow of the oxidizing gas exiting therefrom. The angle of twist utilized in preferred embodiments may comprise approximately 20°.

Oxidizing gas exit openings in the oxidizing gas chamber are disposed at a twisting angle to the longitudinal dimension of said rotatable fuel tube to twist the flow of the oxidizing gas exiting therefrom. Such twisting angle is also approximately 20°. The oxidizing gas openings comprise at least one circular array, of preferably up to approximately 20 equally radially spaced oxidizing gas openings, although other numbers of openings are contemplated.

The gaseous fuel openings are disposed in at least one circular array on the gaseous fuel chamber wall. The gaseous fuel openings in such preferred embodiments comprise at least one circular array of approximately 6 equally radially spaced gaseous fuel openings, although other numbers of gaseous fuel openings are contemplated.

The improved burner apparatus of the present invention may also preferably comprises a discharge sleeve for generally containing the flame of the burner and disposed adjacent the oxidizing gas wall and the generally coextensive gaseous fuel chamber wall and opposite the rotatable face plate to receive and generally confine combustion therefrom.

The fuel openings of the gaseous fuel chamber wall are preferably disposed substantially parallel to the longitudinal axis of the gaseous fuel chamber. In preferred embodiments of the improved burner apparatus of the present invention the gaseous fuel openings of the rotatable face place are similarly matchingly disposed substantially parallel to the longitudinal axis of the gaseous fuel chamber.

In preferred embodiments, the coextensive wall of the gaseous fuel chamber and the oxidizing gas chamber is stationarily disposed and may be unitarily formed, such as in the configuration of a plate. Such unitarily formed, stationary, coextensive wall may be preferably disposed immediately exterior to and in substantial contact with the rotatable face plate and thereby its matching oxidizing gas exit openings and its similarly matching gaseous fuel openings.

Referring now to the drawing and to FIG. 1 in particular, the improved adjustable combustion rate stoichiometrically operable burner of the present invention generally 10 includes an oxidizing gas housing 12 defining an oxidizing gas chamber 14. Such oxidizing gas chamber 14 functions to contain an oxidizing gas, such as air, although mixtures of air and oxygen for enrichment purposes may also be utilized. Oxidizing gas chamber 14 has a terminal oxidizing gas wall 16 with a plurality of large oxidizing gas exit openings 18, and in preferred embodiments some smaller oxidizing gas exit openings 20 therein.

A gaseous fuel tube 22 defining a gaseous fuel chamber 24 is disposed within oxidizing gas chamber 14 and may be preferably concentrically disposed therewithin as shown in FIG. 1. Gaseous fuel chamber 24 has a wall 26 which is generally coextensive with the oxidizing gas wall 16 of oxidizing gas chamber 14, as is particularly shown in FIGS. 2 and 4 and gaseous fuel openings 21 therein.

Figure 3:
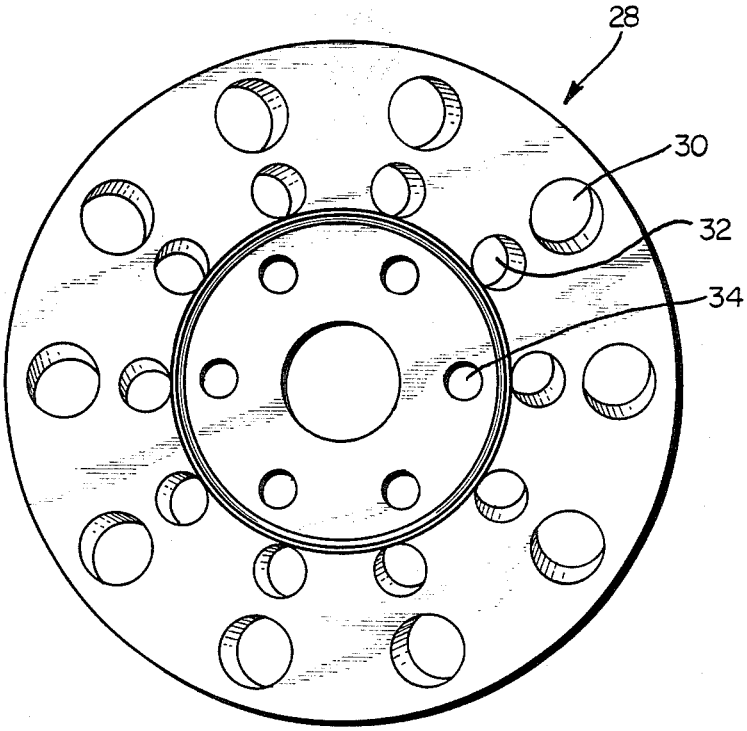
FIG. 3 is a greatly enlarged front view of the rotatable face plate as shown in FIG. 1 and showing concentrically disposed air exit openings and gaseous fuel openings corresponding to those as set forth in the coextensive wall plate of FIG. 2.

A rotatable face plate 28 is disposed for covering a portion of wall 26 of the oxidizing gas chamber 14, and simultaneously wall 16 of gaseous fuel chamber 14, as is particularly shown in FIG. 3. Such rotatable face plate 28 has openings 30, 32 and 34 therein substantially corresponding in shape, size and location respectively to oxidizing gas openings 18,20 in wall 16 of oxidizing gas chamber 14 and gaseous fuel openings 21 in wall 26 of gaseous fuel chamber 24. Hence, improved burner apparatus 10 of the present invention functions upon rotation of rotatable face plate 28 to expose selected and variable cross-sectional area of paired oxidizing gas openings 18,30 and 20,32 and paired gaseous fuel openings 21, 34 for simultaneous opening to the ambient atmosphere to maintain the preselected ratio of oxidizing gas to the gaseous fuel upon burning thereof.

Figure 2:
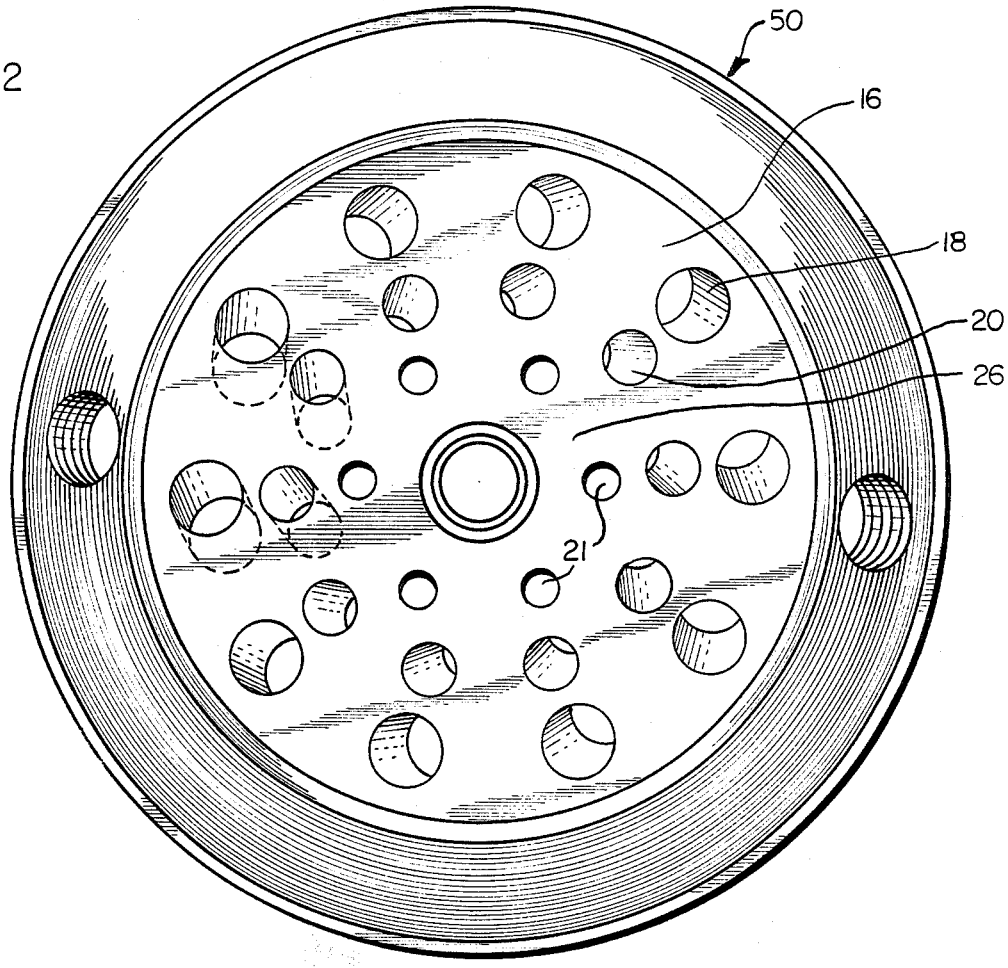
FIG. 2 is a greatly enlarged front view of the coextensive wall shown in the form of a wall plate, such coextensive wall for the air chamber and the gaseous fuel tube, and showing two sets of concentrically disposed air exit openings each having a converging and twisting configuration, and further showing also concentrically disposed fuel gas openings which are disposed interior to such exit openings, and yet further showing exteriorally disposed attachment holes.
Figure 4:
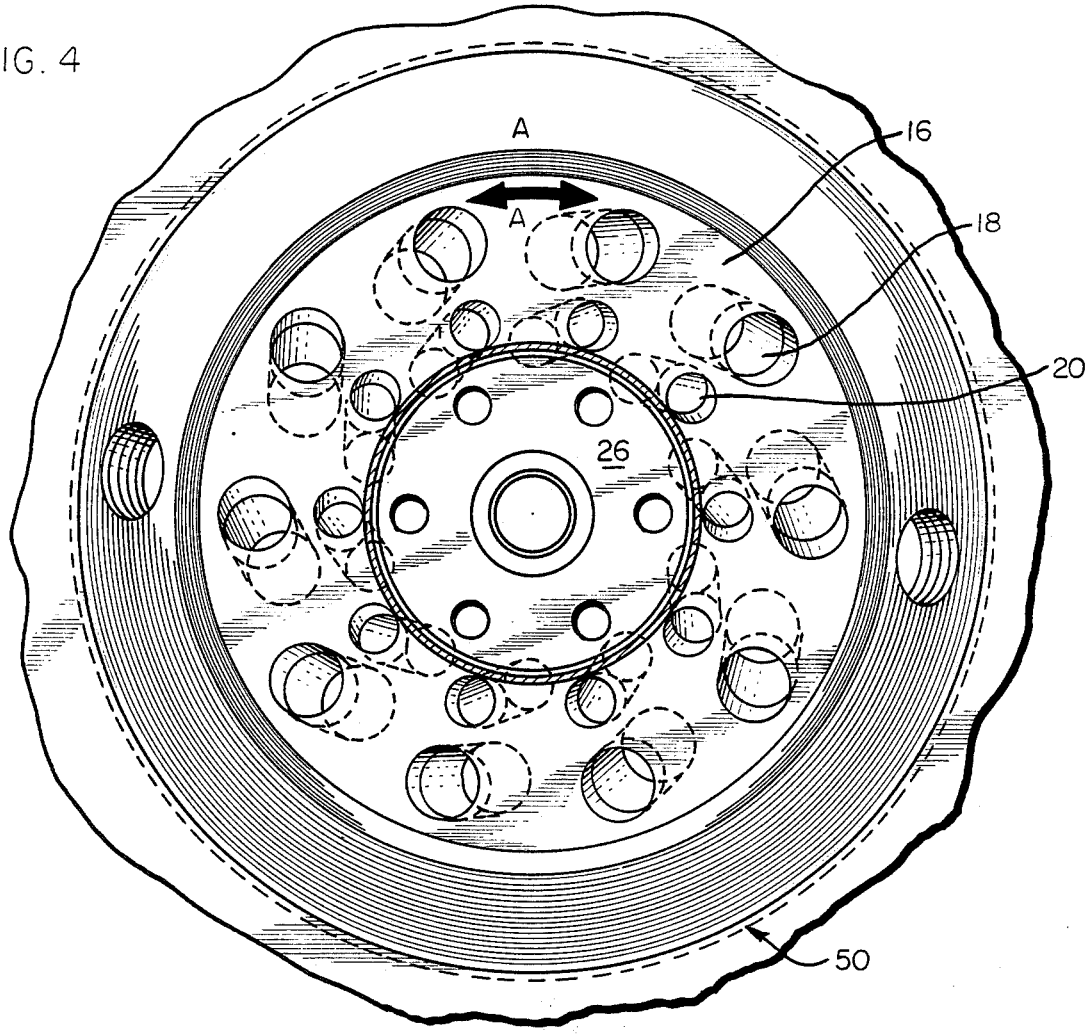
FIG. 4 is a similarly greatly enlarged end view taken along lines 4—4 of FIG. 1 and showing the coextensive wall plate of FIG. 2 disposed in operable configuration over the rotatable face plate of FIG. 3 and showing at Arrows A—A the rotational disposition of the rotatable face plate with respect to the fixed wall plate to control the turn-down or turn-up ratio of the burner while maintaining essentially stoichiometric combustion.

As shown in FIGS. 2 and 4, in preferred embodiments of the improved burner apparatus 10 of the present invention, oxidizing gas openings 18,20 in oxidizing gas wall 16 are disposed in two concentric circular arrays on oxidizing gas wall 16. Such oxidizing gas openings 18,20 are disposed to provide a plurality of converging oxidizing gas streams therefrom, as shown in FIG. 1. Such oxidizing gas openings 18,20 are also further disposed to provide a plurality of twisting streams of oxidizing gas therefrom, as shown in FIGS. 2 and 4.

Figure 5:
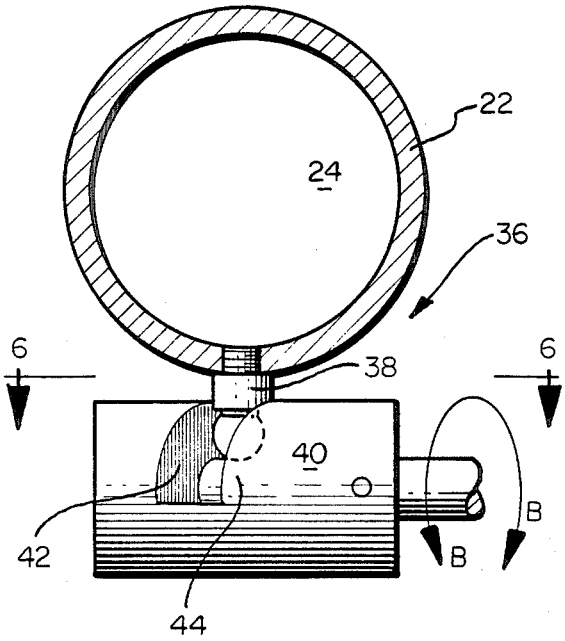
FIG. 5 is a greatly enlarged and partially cross-sectional view taken along lines 5—5 of FIG. 1 of the manually operable apparatus for operating the rotatable face plate through cam and associated cam follower means, as shown by rotating such cam in the direction of Arrow B—B.
Figure 6:
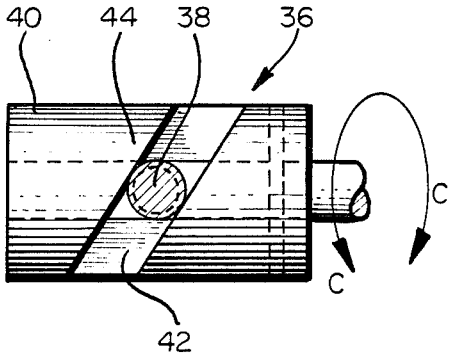
FIG. 6 is a cross-sectional view of the manually operable apparatus of FIG. 5 taken along lines 6—6 of FIG. 5, and further showing the cam and cam follower mechanism for turning the gaseous fuel tube, and accordingly the rotating face plate, when such cam is moved in the direction shown at Arrow C—C.

Rotating face plate 28 is attached to gaseous fuel tabe 22 as shown in the preferred embodiment and is rotatable by rotation of fuel tube 22. Rotatable fuel tube 22 is sealingly disposed on fuel tube housing 23 by means of an annular seal 25. As shown in FIGS. 1, 5 and 6, rotational means generally 36 for driving the rotatable fuel tube in a rotational configuration, simultaneously to control the amount of gaseous fuel and oxidizing gas exiting from the face plate 28 is likewise provided. Rotatable means 36 may preferably comprise a cam guide 38 attached to gaseous fuel tube 22, with a cam 40 disposed substantially transversely to the longitudinal dimension of gaseous fuel tube 22. Such cam 40 as shown in FIGS. 5 and 6 has a cam followerslot 42 with cam guide 38 disposed therewithin. Such cam mechanism 38,40,42 functions when cam 40 is turned and force is thereby directed against the cam guide 38, which in turn rotates attached gaseous fuel tube 22 and thereby simultaneously controls the amount of oxidizing gas and gaseous fuel exiting from face plate 28. In these preferred embodiments of the improved burner apparatus 10 of the present invention as shown in FIGS. 5 and 6, the cam follower slot 42 is disposed obliquely across the exterior surface 44 of cam 40. In such embodiments as shown cam 40 is substantially cylindrical in shape. A manually graspable knob 46, as shown in FIG. 1, is further provided for turning cam 40 to control simultaneously the amount of gaseous fuel and oxidizing gas exiting from face plate 28.

In the above preferred embodiments, the cam follower slot 42 is disposed preferably obliquely across exterior surface 44 of cam 40 at an angle of approximately 33° to the transverse of cam 40.

In the embodiment of the improved burner apparatus of the present invention shown in FIG. 1, a blower assembly generally 48 is operably connected to oxidizing gas chamber 14 for supplying oxidizing gas to oxidizing gas chamber 14.

As shown in FIGS. 3 and 4, oxidizing gas openings 30,32 within rotatable face plate 28 are preferably disposed at an angle of approximately 10° to the longitudinal axis of rotatable gaseous fuel tube 22, thereby to provide a converging shape to the oxidizing gas expelled therethrough, as shown in FIG. 1. Oxidizing gas openings 18,20 of oxidizing gas chamber 16 are preferably also disposed at an angle of approximately 10° to the longitudinal axis of the rotatable gaseous fuel tube 22, thereby to provide a converging shape to the oxidizing gas expelled therethrough. Such oxidizing gas openings 30,32 in the rotatable face plate 28 and the oxidizing gas openings 18,20 in oxidizing gas chamber 14 are correspondingly converging in disposition with respect to the longitudinal axis of the rotatable gaseous fuel tube 22 to provide converging flames exiting therefrom. Such oxidizing gas openings 30,32 in the rotatable face plate 28 are further disposed at a twisting angle to the longitudinal dimension of rotatable gaseous fuel tube 22, as shown in FIGS. 3 and 4. Such structure functions to twist the flow of the oxidizing gas exiting therefrom. The angle of twist utilized in the preferred embodiments shown in FIGS. 1–4 may comprise approximately 20°. Oxidizing gas exit openings 18,20 in oxidizing gas chamber 14 are disposed at a twisting angle to the longitudinal dimension of said rotatable gaseous fuel tube 22 to twist the flow of the oxidizing gas exiting therefrom. Such twisting angle is also approximately 20°.

The respective oxidizing gas openings 18,20 and 30,32 may comprise two circular arrays, of preferably 10 equally radially spaced oxidizing gas openings. The respective gaseous fuel openings 21,34 are disposed in one circular array. Gaseous fuel openings 21,34 in such preferred embodiments comprise one circular array of 6 equally radially spaced gaseous fuel openings.

The improved burner apparatus 10 of the present invention may also include a discharge sleeve 49 for generally containing the flame of the burner 10 and disposed adjacent oxidizing gas wall 16 and the generally coextensive gaseous fuel chamber wall 26 to receive the combustion products therefrom.

The gaseous fuel openings 21 of gaseous fuel chamber wall 26 are preferably disposed substantially parallel to the longitudinal axis of gaseous fuel chamber 24, as shown in FIG. 1. Gaseous fuel openings 34 of rotatable face plate 28 are likewise disposed substantially parallel to the longitudinal axis of gaseous fuel chamber 24.

In preferred embodiments, the coextensive wall 16,26 of gaseous fuel chamber 24 and the oxidizing gas chamber 14 may be unitarily formed, such as in the configuration of a plate generally 50, as shown in FIGS. 2 and 4. Such unitarily formed coextensive wall plate 50 may be preferably disposed immediately exterior to and in substantial contact with the rotatable face plate 28, as shown in FIGS. 1 and 4.

As shown in FIG. 1, blower assembly 48 includes a motor 52 supported by motor bracket 53 driving a fan 54 through shaft 56 within a fan housing 58.

The basic and novel characteristics of the improved apparatus of the present invention will be readily understood from the foregoing disclosure by those skilled in the art. It will become readily apparent that various changes and modifications may be made in the form, construction and arrangement of the improved apparatus of the present invention as set forth hereinabove without departing from the spirit and scope of the invention. Accordingly, the preferred and alternative embodiments of the present invention set forth hereinabove are not intended to limit such spirit and scope in any way.

What is claimed is:

1. An improved adjustable combustion rate, air/fuel proportioned burner comprising:

an oxidizing gas housing defining an oxidizing gas chamber for containing an oxidizing gas;

said oxidizing gas chamber including an oxidizing gas exit wall with a plurality of oxidizing gas exit openings therein;

a gaseous fuel tube defining a gaseous fuel chamber, said gaseous fuel chamber disposed within said oxidizing gas chamber;

said gaseous fuel chamber having a wall generally coextensive with said oxidizing gas exit wall of said oxidizing gas chamber, and having gaseous fuel openings therein;

a rotatable face plate covering a portion of said coextensive wall of said oxidizing gas chamber and simultaneously said wall of said gaseous fuel chamber, and having openings therein substantially corresponding in shape, size and location to said oxidizing gas openings in said wall of said oxidizing gas chamber and said gaseous fuel openings in said wall of said gaseous fuel chamber, said rotating face plate being connected to said gaseous fuel tube and being rotatable by rotation of said fuel tube;

whereby upon rotation of said rotatable face plate a selected and variable cross-sectional area of said oxidizing gas openings and said gaseous fuel openings are simultaneously opened to the ambient atmosphere for respective flow therefrom of oxidizing gas and gaseous fuel to maintain the preselected ratio of oxidizing gas to the gaseous fuel upon combustion thereof.

2. The improved adjustable combustion rate, air/fuel proportioned burner of claim 1 wherein said oxidizing gas openings in said oxidizing gas wall are disposed in at least one circular array on said oxidizing gas wall.

3. The improved adjustable combustion rate, air/fuel proportioned burner of claim 2 wherein said oxidizing gas openings are disposed to provide a plurality of converging oxidizing gas streams therefrom.

4. The improved adjustable combustion rate, air/fuel proportioned burner of claim 3 wherein said oxidizing gas openings are further disposed to provide a plurality of twisting streams of oxidizing gas therefrom.

5. The improved adjustable combustion rate, air/fuel proportioned burner of claim 2 wherein said oxidizing gas openings in said oxidizing gas wall are disposed in a pair of concentrically disposed circular arrays.

6. The improved adjustable combustion rate, air/fuel proportioned burner of claim 1 further comprising rotation means for driving said rotatable fuel tube in rotational configuration simultaneously to control the amount of gaseous fuel and oxidizing gas exiting from said face plate.

7. The improved adjustable combustion rate, air/fuel proportioned burner of claim 6 wherein said rotation means comprises a cam guide attached to said gaseous fuel tube, a cam disposed substantially transversely to the longitudinal dimension of said gaseous fuel tube, said cam having a cam follower slot with said cam guide disposed therewithin, whereby when said cam is turned force is directed against said cam guide which rotates said attached fuel tube, and therefrom said face plate, and thereby simultaneously controls the amount of oxidizing gas and gaseous fuel exiting from said face plate.

8. The improved adjustable combustion rate, air/fuel proportioned burner of claim 7 wherein said cam follower slot is disposed obliquely across the exterior surface of said cam.

9. The improved adjustable combustion rate, air/fuel proportioned burner of claim 7 wherein said cam is substantially cylindrical in shape.

10. The improved adjustable combustion rate, air/fuel proportioned burner of claim 7 further comprising a manually graspable knot for turning said cam to control simultaneously the amount of gaseous fuel and oxidizing gas exiting from said face plate.

11. The improved adjustable combustion rate, air/fuel proportioned burner of claim 1 further comprising blower means operatively connected to said oxidizing gas chamber for supplying oxidizing gas to said oxidizing gas chamber.

12. The improved adjustable combustion rate, air/fuel proportioned burner of claim 8 wherein said cam is disposed obliquely across the exterior surface of said cam at an angle of approximately 33° to the transverse of said cam.

13. The improved adjustable combustion rate, air/fuel proportioned burner of claim 1 wherein said oxidizing gas openings within said rotatable face plate are disposed at an angle of approximately 10° to the longitudinal axis of said rotatable oxidizing gas tube to provide a converging shape to the oxidizing gas expelled therethrough.

14. The improved adjustable combustion rate, air/fuel proportioned burner of claim 1 wherein said oxidizing gas openings of said oxidizing gas chamber are disposed at an angle of approximately 10° to the longitudinal axis of said rotatable oxidizing gas tube to provide a converging shape to the oxidizing gas expelled therethrough.

15. The improved adjustable combustion rate, air/fuel proportioned burner of claim 1 wherein the oxidizing gas openings in said rotatable face plate and the oxidizing gas openings in said oxidizing gas chamber are correspondingly converging in disposition with respect to the longitudinal axis of said rotatable gaseous fuel tube.

16. The improved adjustable combustion rate, air/fuel proportioned burner of claim 1 wherein said oxidizing gas openings in said rotatable face plate are disposed at a twisting angle to the longitudinal dimension of said rotatable fuel tube to twist the flow of the oxidizing gas exiting therefrom.

17. The improved adjustable combustion rate, air/fuel proportioned burner of claim 16 wherein said angle of twist is approximately 20°.

18. The improved adjustable combustion rate, air/fuel proportioned burner of claim 1 wherein said oxidizing gas exit openings in said oxidizing gas chamber are disposed at a twisting angle to the longitudinal dimension of said rotatable fuel tube to twist the flow of the oxidizing gas exiting therefrom.

19. The improved adjustable combustion rate, air/fuel proportioned burner of claim 18 wherein said twisting angle is approximately 20°.

20. The improved adjustable combustion rate, air/fuel proportioned rable burner of claim 2 wherein said oxidizing gas openings comprise at least one circular array of at least approximately 10 equally radially spaced oxidizing gas openings.

21. The improved adjustable combustion rate, air/fuel proportioned burner of claim 1 wherein said gaseous fuel openings are disposed in at least one circular array on said gaseous fuel chamber wall.

22. The improved adjustable combustion rate, air/fuel proportioned burner of claim 21 wherein said gaseous fuel openings comprise at least one circular array of at least approximately 6 equally radially spaced gaseous fuel openings.

23. The improved adjustable combustion rate, air/fuel proportioned burner of claim 1 further comprising a discharge sleeve for generally containing the flame of said burner and disposed adjacent said oxidizing gas wall and said generally coextensive gaseous fuel chamber wall to receive the combusting products and flame therefrom.

24. The improved adjustable combustion rate, air/fuel proportioned burner of claim 1 wherein said gaseous fuel openings of said gaseous fuel chamber wall are disposed substantially parallel to the longitudinal axis of said gaseous fuel chamber.

25. The improved adjustable combustion rate, air/fuel proportioned burner of claim 1 wherein said gaseous fuel openings of said rotatable face plate are disposed substantially parallel to the longitudinal axis of said gaseous fuel chamber.

26. The improved adjustable combustion rate, air/fuel proportioned burner of claim 1 wherein said coextensive wall of said gaseous fuel chamber and said oxidizing gas chamber is unitarily formed.

27. The improved adjustable combustion rate, air/fuel proportioned burner of claim 26 wherein said unitarily formed coextensive wall is disposed immediately exterior to and in substantial contact with said rotatable face plate.

* * * * *